United States Patent [19]

Kusano et al.

[11] Patent Number: 4,636,682

[45] Date of Patent: Jan. 13, 1987

[54] IMAGE PICKUP TUBE

[75] Inventors: Chushirou Kusano, Tokorozawa; Sachio Ishioka, Toshima; Yoshinori Imamura, Hachioji; Yukio Takasaki, Hachioji; Hirofumi Ogawa, Hachioji; Tatsuo Makishima, Hachioji; Tadaaki Hirai, Koganei, all of Japan

[73] Assignee: Hitachi, Ltd., Tokyo, Japan

[21] Appl. No.: 491,921

[22] Filed: May 5, 1983

[30] Foreign Application Priority Data

May 10, 1982 [JP] Japan ..... 57-76736

[51] Int. Cl.[4] ..... H01J 31/00

[52] U.S. Cl. ..... 313/386; 313/384; 313/387

[58] Field of Search ..... 313/386, 366, 384, 385, 313/387; 358/217

[56] References Cited

U.S. PATENT DOCUMENTS

| | | | |
|---|---|---|---|
| 3,348,610 | 9/1982 | Dieleman et al. | 313/386 |
| 3,982,149 | 9/1976 | Dieleman et al. | 313/366 |
| 3,984,722 | 10/1976 | Maruyama et al. | 313/386 |
| 3,987,327 | 10/1976 | Wronski et al. | 313/386 |
| 4,255,686 | 3/1981 | Maruyama et al. | 313/366 |
| 4,348,610 | 9/1982 | Dieleman et al. | 313/386 |
| 4,469,985 | 9/1984 | Inoue et al. | 313/386 |

OTHER PUBLICATIONS

"Hitachi Saticon", Hitachi, Ltd., 3/79, pp. 3-7.

*Primary Examiner*—David K. Moore

*Attorney, Agent, or Firm*—Antonelli, Terry & Wands

[57] ABSTRACT

A high velocity electron beam scanning negatively charge biased image pickup tube has a target which includes at least a transparent conductive layer, a photoconductor layer and a layer for secondary electron emission on a light-transmissive insulating substrate, and in which the transparent conductive layer is arranged on a light incidence side, the photoconductor layer being made of amorphous silicon.

19 Claims, 9 Drawing Figures

IMAGE PICKUP TUBE

BACKGROUND OF THE INVENTION

1. Field of the Invention

The present invention relates to a high velocity electron beam scanning negatively charge biased photoconductive image pickup tube in which a photoelectric signal is read by scanning a target with a high velocity electron beam.

2. Description of the Prior Art

The high velocity electron beam scanning negatively charge biased image pickup tube has been known for a long time as possessing, in principle, the advantage that the capacitive lag is negligible owing to a low beam resistance and that substantially no beam bending is involved. Thus, image pickup tube characteristics unattainable in the past can be expected. Examples of the image pickup tube of the specified type are contained in the official gazette of Japanese Laid-open Patent Application No. 54-44487, an article by J. Dressner; RCA Review, June (1961), pp. 305–324, "High Beam Velocity Vidicon", etc. Since, however, a photoconductive material meeting the aforementioned merits has not been found as yet, the image pickup tube has not been put into practical use.

On the other hand, it has been known that amorphous silicon containing hydrogen (hereinbelow, abbreviated to "a-Si:H") exhibits a high photoelectric conversion efficiency. A photoconductive image pickup tube employing an a-Si:H photoconductive layer has already been proposed. Examples of such image pickup tube are contained in U.S. Pat. No. 4,255,686 and British Pat. No. 1,349,351.

All the examples, however, concern image pickup tubes of the low velocity electron beam scanning type (hereinbelow, termed "LP operation mode").

When an amorphous silicon layer is used as a photoconductive layer in the image pickup tube of the LP operation mode, the characteristics of the tube are subject to such limitations as (1) inferior lag characteristics, (2) inferior photo-response for light of shorter wavelength, and (3) a distorted picture ascribable to the bending of the scanning electron beam.

It has accordingly been impossible to expect sharp enhancements in the characteristics of the device under the current circumstances.

SUMMARY OF THE INVENTION

The present invention consists in a high velocity electron beam scanning negatively charge biased image pickup tube comprising a target which includes at least a transparent conductive layer, a photoconductor layer and a layer for secondary electron emission on a light-transmissive insulating substrate, and in which the transparent conductive layer is arranged on a light incidence side, the photoconductor layer being made of amorphous silicon.

In the high velocity electron beam scanning negatively charge biased image pickup tube, the secondary emission ratio of the target is set to be at least 1 (one), and the potential of the accelerating electrode is set to be higher than that of the transparent conductive layer.

DETAILED DESCRIPTION OF THE INVENTION

First of all, the points of difference between the HN operation mode and the LP operation mode wil be briefly explained.

Figure 1:
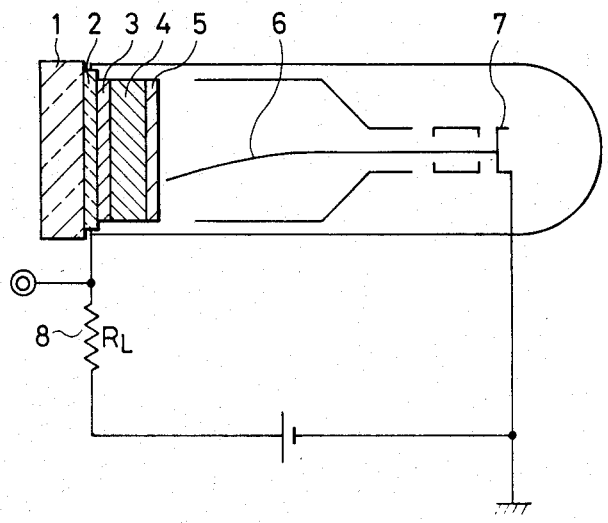
FIG. 1 is a sectional view of a photoconductive image pickup tube of a prior-art type.

FIG. 1 is a view showing an example of an image pickup tube of the LP operation mode. Referring to the figure, numeral 1 designates a light-transmissive substrate, numeral 2 a transparent conductive layer, numeral 3 a light-transmissive n-type semiconductor layer, numeral 4 an a-Si:H photoconductive layer, and numeral 5 a scanning electron beam landing layer which functions to suppress the ratio of secondary emission based on a scanning electron beam 6 so as to be less than 1 (one). This image pickup tube is operated in the state in which the transparent conductive layer 2 is usually positively biased ten odd V–several tens V with respect to a cathode 7, as illustrated in the figure. Accordingly, that surface of the target of the image pickup tube which is sequentially scanned by the electron beam balances the cathode potential after the scanning, and the photoconductive layer is biased so that its side on which light enters may normally have a positive potential. When the light has entered, electrons created within the photoconductive layer flow to the transparent conductive layer, and holes flow to the side scanned by the electron beam, so that the potential of the target surface rises. When the surface is scanned by the electron beam again, the surface potential rise components corresponding to an optical image can be time-sequentially derived as an external output signal through a load resistor 8. Such image pickup tube is called the "image pickup tube of the LP operation mode" because the target surface is normally scanned by the low velocity electron beam. Meanwhile, the a-Si:H layer has a great absorption coefficient for the visible radiation, so that the majority of the electron-hole pairs based on the light is created in the vicinity of the transparent conductive layer. Accordingly, the transition of the holes becomes an important factor governing the characteristics of the image pickup tube.

The above is the operating principle of the image pickup tube of the LP operation mode employing the amorphous silicon layer.

Figure 2:
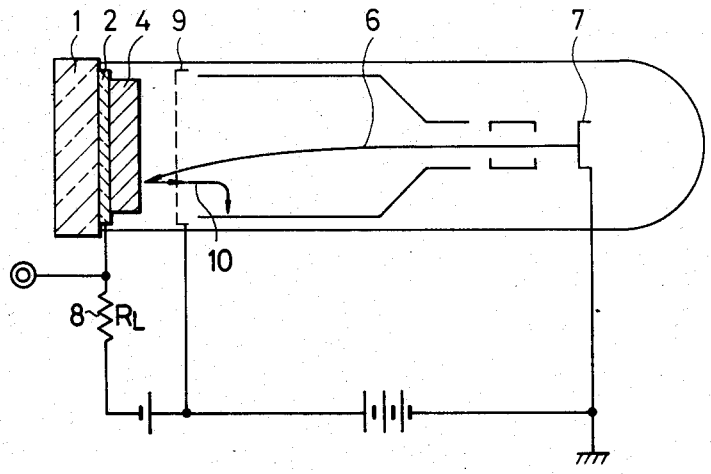
FIG. 2 is a sectional view of a photoconductive image pickup tube according to the present invention.

FIG. 2 shows a schematic view for elucidating the principle operation of the present invention, namely, the HN operation. Numeral 1 designates a light-transmissive substrate, numeral 2 a transparent electrode, numeral 4 a photoconductor layer containing a-Si:H as its principal constituent, numeral 9 a mesh electrode, and numeral 7 a cathode. In operation, a positive voltage which is usually higher than the cathode 7 by at least 100 V is applied to the transparent conductive layer 2. In general, the secondary emission ratio (hereinafter, written "δ") of the target is rendered at least 1 (one) in use. At this time, the potential of the mesh electrode 9 located near the target is set so as to become still higher than that of the transparent electrode 2. In case of the HN operation mode, the mesh electrode is not always necessary, but it is often employed as a kind of accelerating electrode. When scanned by an electron beam 6 under such state, the photoconductive target surface emits secondary electrons 10 to balance the potential of the mesh electrode 9 and to assume a positive potential with respect to the transparent electrode 2. Accordingly, an electric field acting on the photoconductive layer becomes opposite in sense to that in the LP mode of FIG. 1, and electron-hole pairs produced by light flow in the opposite direction, so that the scanned surface potential changes in the negative direction or falls contrariwise to the case of the LP mode. By subsequently scanning the target surface with the electron beam 6, the surface potential fall components corresponding to the intensities of an optical image are derived as a signal through a load resistor 8. Such scanning mode is called the "high velocity beam scanning negatively charge biased (HN) operation mode".

The transparent conductive layer has its potential set within a range of approximately 100 V–2,000 V relative to the cathode.

The mesh electrode is set at a higher potential having a difference of approximately several tens V from the potential of the transparent conductive layer. The difference is a potential which is actually applied to the photoconductor layer, and it is set in conformity with the material and thickness of this layer and the required characteristics of the image pickup tube.

The inventor took the lead in applying an a-Si:H layer to the target of an image pickup tube, and repeated to scrupulously conduct the experiment of operating the image pickup tube in the HN mode. Then, he has discovered that, besides the effects of reducing the capacitive lag and the beam bending as expected of the HN mode, the effect of sharply reducing photoconductive lag, the effect of enhancing photo-response for blue light, etc. as unforeseen at the beginning can be attained without any damage in a photoelectric conversion characteristic of high efficiency, a thermal stability, a resistance to intense light, a mechanical strength, etc. which are inherent in the a-Si:H layer.

Figure 3:
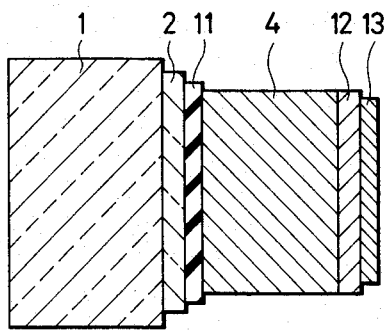
FIGS. 3, 5 and 6 are sectional views of image pickup tube targets according to the present invention.

Now, FIG. 3 shows a typical example of an image pickup tube target structure in the present invention. Numeral 1 designates a light-transmissive substrate, numeral 2 a transparent conductive layer, numeral 11 a light-transmissive p-type semiconductor layer for blocking the injection of electrons from the transparent conductive layer, numeral 4 an a-Si:H photoconductive layer, numeral 12 an n-type semiconductor layer for blocking the injection of holes from an electron beam scanning side, and numeral 13 a secondary electron emission layer for attaining more effective secondary emission based on the high velocity electron beam scanning. The a-Si:H photoconductive layer 4 can be produced by reactive sputtering which uses an Si plate as a target and which is performed in a mixed gas atmosphere consisting of argon and hydrogen, the glow discharge CVD which is performed in an atmosphere gas containing at least $SiH_4$, or the like. The optical forbidden band gap of the a-Si:H layer can be widely varied depending upon the temperature of the substrate during the formation thereof, the content of hydrogen gas, and the quantities of impurity gases such as $SiF_4$ and $GeH_4$. It is desirable that the forbidden band gap of the a-Si:H layer for use in the present invention lies within a range from 1.4 eV to 2.2 eV. While hydrogen can be contained up to 50 atomic-% or so, a content of approximately 5–35 atomic-% is generally desirable. The reasons are that when the forbidden band gap is smaller than 1.4 eV, the dark resitivity lowers excessively, so that an inferior resolution and the presence of unnecessary photo-response for near-infrared radiation are feared, whereas when it is greater than 2.2 eV, the photo-response for red light lowers. The most desirable is a range from 1.6 eV to 2.0 eV. In terms of the hydrogen content, this range corresponds to a range from 10 to 25 atomic-% or so. The thickness of the a-Si:H photoconductive layer may be determined by inversely calculating it from the absorption coefficient for light and the required spectral response of the image pickup tube. A range from 0.2 μm to 10 μm is usually suitable, and a range from 0.5 μm to 4 μm is desirable when the operating voltage, the period of time for production, the probability of occurrence of a surface defect, etc. are considered.

In order to control the conductivity type thereof, the amorphous silicon can of course be doped with a p-type dopant such as B, Al, Ga and In and an n-type dopant such as N, P and As, which are commonly known as dopants for silicon, as may be needed. In addition, amorphous silicon doped with fluorine together with hydrogen has been known, and such amorphous silicon materials are naturally applicable to the present invention.

The light-transmissive p-type semiconductor layer 11, the n-type semiconductor layer 12 and the secondary electron emission layer 13 are not always necessary, and the a-Si:H layer itself can also be furnished with the functions of the respective layers. However, the provision of the above layers is desirable for rendering the effects of the present invention the most prominent.

Effective for the light-transmissive p-type semiconductor layer 11 is amorphous silicon which contains hydrogen and a group-IIIb element such as boron and aluminum, or an amorphous solid solution which contains silicon, carbon and hydrogen. Besides, the light-transmissive p-type semiconductor layer 11 may be replaced with a light-transmissive metal film of Au, Pt, Pd or the like (usually presenting a semitransparent state) so as to utilize the rectifying heterojunction between the metal film and the a-Si:H layer.

Desirable for the n-type semiconductor layer 12 is amorphous silicon nitride, amorphous silicon which contains hydrogen and a group-Vb element such as phosphorus and arsenic, or the like.

Desirably, the thickness of each of the p-type semiconductor layer 11 and n-type semiconductor layer 12 is from at least 1 nm to at most 50 nm, and the content of the group-IIIb or group-Vb element lies in a range from 0.5 ppm to 200 ppm. Below the range, the effect is slight, and above the range, the resistance lowers excessively to degrade the photo-response and the resolution. Besides, the group-IIIb and group-Vb impurity elements need not be confined in only the p-type semiconductor layer and n-type semiconductor layer respectively, but it is rather desirable that they are added so as to have densities decreasing from both the boundary surfaces of the a-Si:H photoconductive layer 4 toward the interior thereof respectively. In this case, also the impurity region within the photoconductor layer may be deemed the p-type semiconductor layer or n-type semiconductor layer.

Figure 4A:
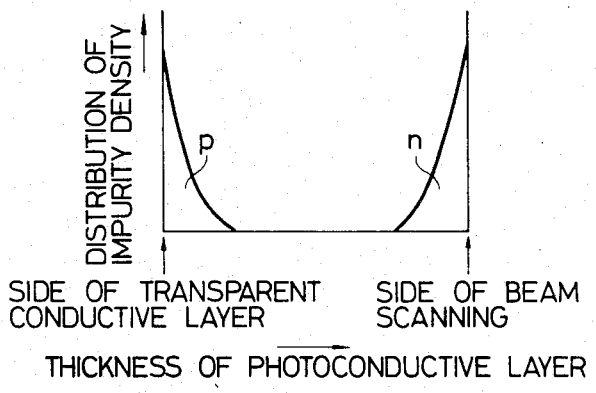
FIGS. 4*a* and 4*b* are diagrams each showing an example of the distribution of impurities in a photoconductor layer.
Figure 4B:
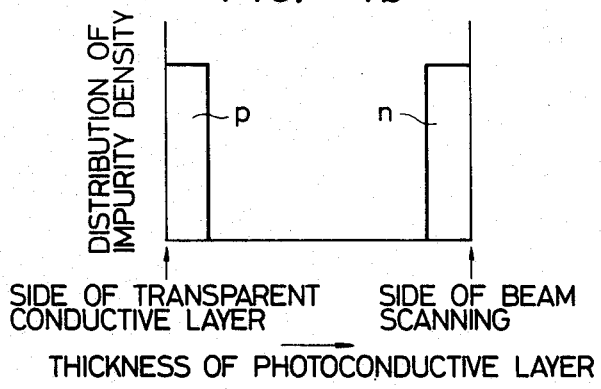

FIGS. 4*a* and 4*b* illustrate examples of such impurity distribution. In the figures, letters p and n denote the p-type impurity and n-type impurity respectively. The impurities may well be introduced in the form of steps as shown in FIG. 4*b*.

The secondary electron emission layer 13 is required to have a secondary emission ratio of at least 1 (one) with respect to scanning electrons accelerated by the mesh voltage during the operation, namely, 0.1–2.0 kV, and also to have an electric resistivity of at least $10^{10}\Omega$-cm and an excellent endurance against electron bombardment. Materials fulfilling these requirements include oxides or fluorides, among which MgO, BaO, $CeO_2$, $Nb_2O_5$, $Al_2O_3$, $SiO_2$, $MgF_2$, $CeF_4$, $AlF_3$, etc. are especially favorable. Regarding the thickness of this layer, a range from 3 nm to 30 nm is desirable.

It is also allowed to provide only one of the n-type semiconductor layer 12 and secondary electron emission layer 13 mentioned above, and the functions of both the layers can be achieved by either layer.

The present invention will now be described more in detail in connection with examples.

EXAMPLE 1

Figure 5:
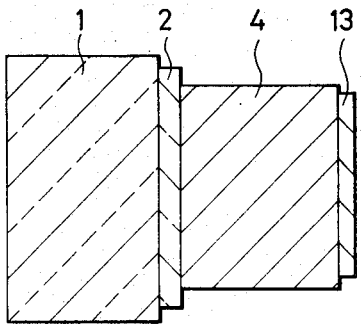

This example will be explained with reference to FIG. 5.

A transparent conductive layer 2 principally containing tin oxide was formed on a glass substrate 1. Subsequently, in a radio-frequency sputtering equipment, an Si material of high purity was used as a target, and the resultant substrate was set so as to confront the target. After the interior of the equipment was evacuated to a high degree of vacuum below $1\times10^{-6}$ Torr, a gaseous mixture consisting of argon and hydrogen was introduced to bring the interior of the equipment into a pressure of $5\times10^{-4}$–$5\times10^{-3}$ Torr. The concentration of hydrogen in the gaseous mixture was rendered 30–65%. After setting the temperature of the substrate at 150° C.–300° C., the reactive sputtering was performed to deposit an a-Si:H layer 4 having a thickness of approximately 0.5–4 μm on the substrate 1 formed with the transparent conductive layer 2. Next, in another radio-frequency sputtering equipment, a $CeO_2$ material of high purity was used as a target, and the substrate with the a-Si:H layer deposited thereon was installed so as to confront the target. After the interior of the equipment was evacuated to a high degree of vacuum below $1\times10^{-6}$ Torr, argon was introduced to establish a pressure of $5\times10^{-4}$–$5\times10^{-3}$ Torr, and the substrate temperature was set at 100° C.–200° C. Under these conditions, the sputtering was carried out. Thus, a layer 13 made of cerium oxide was deposited on the a-Si:H layer 4 to a thickness of approximately 5 nm–30 nm. It was used as a secondary electron emission layer.

The photoconductive target fabricated as described above was combined with an electron gun for the HN mode, and a tube was evacuated and sealed. Then, a photoconductive image pickup tube of the HN operation mode was obtained.

EXAMPLE 2

Figure 6:
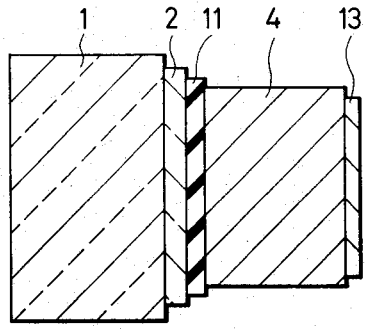

This will be explained with reference to FIG. 6.

A transparent conductive layer 2 principally containing tin oxide and indium oxide was formed on a glass substrate 1. Subsequently, in a radio-frequency sputtering equipment, a Si plate containing boron was used as a target, and the resultant substrate was installed so as to confront the target. Further, plates of C was arrayed like straps on the Si target so that the surface area ratio of Si and C as viewed from the substrate side might become 1:1. After evacuating the interior of the equipment to a high degree of vacuum below $1\times10^{-6}$ Torr, a gaseous mixture consisting of argon and hydrogen was introduced to bring the interior of the equipment into a pressure of $5\times10^{-4}$–$5\times10^{-3}$ Torr. The concentration of hydrogen in the gaseous mixture was rendered 30–60%. Further, the temperature of the substrate was set at 150° C.–250° C., whereupon the sputtering was performed to deposit on the transparent conductive layer a p-type amorphous Si-C semiconductor layer containing hydrogen and boron (hereinafter, abbreviated to "a-SiC:H layer") 11. The p-type a-SiC:H layer 11 served to block the injection of electrons from the transparent conductive layer into an a-Si:H layer to be subsequently deposited, and it was rendered 5–20 nm thick. Next, the resultant substrate was installed in another radio-frequency sputtering equipment which employed a Si material of high purity as a target. Thus, the a-Si:H photoconductive layer 4 explained in Example 1 was deposited. In still another radio-frequency sputtering equipment, an $Al_2O_3$ material of high purity was used as a target, and the resultant substrate was installed so as to confront it. After evacuating the interior of the equipment to a high degree of vacuum below $1\times10^{-6}$ Torr, argon was introduced to establish a pressure of $5\times10^{-4}$–$5\times10^{-3}$ Torr, and the sputtering was performed to form a layer of aluminum oxide 13 on the a-Si:H layer. The thickness of this layer 13 was rendered 5–20 nm. Using the photoconductive target thus fabricated, an image pickup tube of the HN mode was manufactured by the same procedure as in Example 1.

EXAMPLE 3

This example will be explained with reference to FIG. 5. It shows an example wherein p-type and n-type impurities are introduced into a photoconductor layer in the direction of the thickness thereof. It has the impurity density distribution in FIG. 4*b*.

A transparent conductive layer 2 principally containing tin oxide was formed on a glass substrate 1. Subsequently, in a radio-frequency sputtering equipment having a plurality of gas conduits, a Si material of high purity was used as a target, the resultant substrate was installed so as to confront the target, and an a-Si:H layer was deposited by a method similar to that of Example 1. In the initial stage, however, while deborane gas ($B_2H_6$) was being introduced besides the gaseous mixture consisting of argon and hydrogen, a-Si:H was deposited to a thickness of 3 nm–50 nm by setting the content of boron in the a-Si:H so as to become at most 100 ppm. Next, the introduction of the diborane gas was stopped, and the sputtering was continuously performed in the gaseous mixture consisting or argon and hydrogen, to form the a-Si:H layer stated in Example 1. Next, while phosphine gas ($PH_3$) was being introduced into the reaction chamber in addition to the gaseous mixture consisting of argon and hydrogen, the sputtering was performed under a condition set so that the content of phosphorus in a-Si:H to be deposited might become at most 100 ppm. Thus, the a-Si:H was deposited until the layer part containing phosphorus became 3–50 nm. Subsequently, in another sputtering equipment, an MgO material of high purity was used as a target, and the resultant substrate was installed so as to confront the target. After evacuating the interior of the equipment to a high degree of vacuum below $1\times10^{-6}$ Torr, argon was introduced to establish a pressure of $5\times10^{-4}$–$5\times10^{-3}$ Torr, under which the sputtering was carried out. In this way, a layer 13 made of magnesium oxide was deposited on the a-Si layer by 5–30 nm. Using the photoconductive target thus prepared, an image pickup tube of the HN mode was obtained by the same procedure as in Example 1.

Although, in Examples 1, 2 and 3, only the case of fabricating all the layers of a-Si:H and a-SiC:H by the use of the reactive sputtering process has been described, similar layer structures can also be formed by the glow discharge CVD process.

EXAMPLE 4

This example illustrates an example wherein p-type and n-type impurities are introduced into a photoconductor layer so as to have density gradients in the direction of the thickness of the layer. It has the impurity density disribution in FIG. 4*a*.

A transparent conductive layer principally containing $In_2O_3$ was formed on a glass substrate. Next, the resultant substrate was arranged in a radio-frequency sputtering equipment having a plurality of gas conduits, and argon, hydrogen, diborane gas and phospine were introduced to prepare an a-Si:H layer in a range of thickness of 1–4 μm. At that time, boron in the a-Si:H was added into only the part of 50 nm–100 nm in the vicinity of the boundary surface of the transparent conductive layer, and the content of the boron was distributed so as to be at most 100 ppm at the boundary surface and then gradually decrease through a valve operation. Further, phosphorus in the a-Si:H was added into only the part of 50 nm–100 nm in the vicinity of the opposite surface. By similarly operating a valve, the content of the phosphorus was distributed so as to be the largest at the surface with a value of at most 100 ppm and gradually decrease inwards. In the above, the concentration of hydrogen in the atmosphere gas was rendered constant in a range of 30–60%. On the photoconductive layer thus obtained, $Nb_2O_5$ was sputtered and deposited as a layer for secondary electron emission to a thickness of 5 nm–150 nm by the same method as in the foregoing example. Using the photoconductive target, an image pickup tube of the HN mode was manufactured by the same procedure as in Example 1.

The image pickup tubes obtained in Examples 1–4 stated above were operated in the HN mode by the method illustrated in FIG. 2. Remarkable effects on lag and photo-response for blue light were noted in all the cases in comparison with an image pickup tube of the conventional LF operation.

Figure 7:
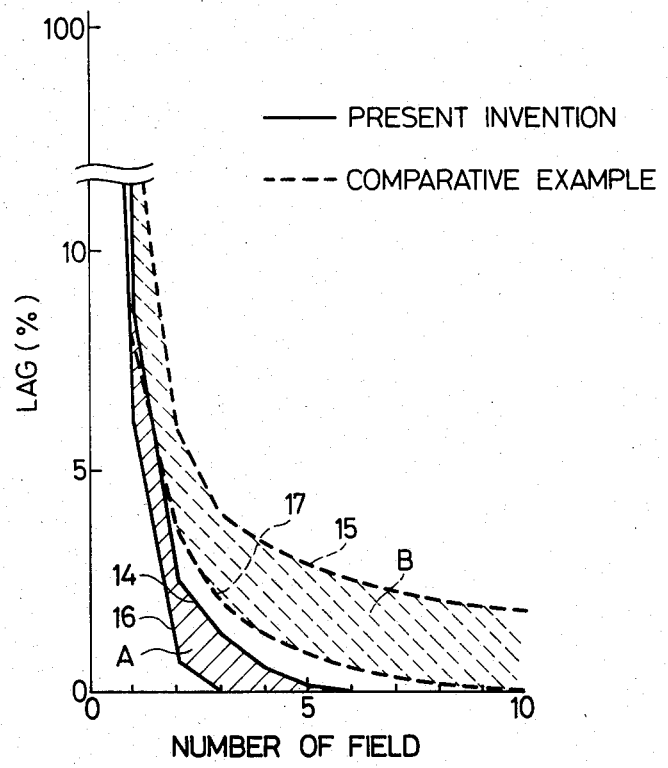
FIG. 7 is a diagram for explaining the effect of improving lag.

FIG. 7 shows the result of the comparison between the lag characteristic 14 of the image pickup tube of the present invention employing the a-Si:H obtained in Example 3 and that 15 of a prior-art image pickup tube of the LP mode. In this figure, the response of a signal after the interception of light is illustrated. The axis of ordinates represents the ratio of the residual signal to a standard signal level in a relative value, while the axis of abscissas represents the number of fields.

In FIG. 7, the curve 15 indicates the lag of the prior-art image pickup tube operated in the LP mode, and a curve 17 indicates the calculated value of the capacitive lag component in this image pickup tube. A hatched area lying between the curves 15 and 17 indicates a photoconductive lag component B. From this relationship, it is understood that the capacitive lag component occupies the greater part of the lag till the third–fifth fields after the interception of the light, whereas the photoconductive lag component B occupies the greater part in the subsequent fields.

On the other hand, the curve 14 indicates the lag of the image pickup tube of the present invention employing the HN mode, and a curve 16 indicates the calculated value of the capacitive lag component in this image pickup tube. A hatched area lying between the curves 14 and 16 indicates a photoconductive lag component A.

It is clear from this relationship that the capacitive lag 16 is sharply reduced by the use of the HN mode. Further, especially the photoconductive lag A is sharply improved by applying the present invention, that is, by employing the hydrogenated amorphous silicon for the photoconductor layer. The sharp improvement of the photoconductive lag A is based on the use of the photoconductor layer.

Figure 8:
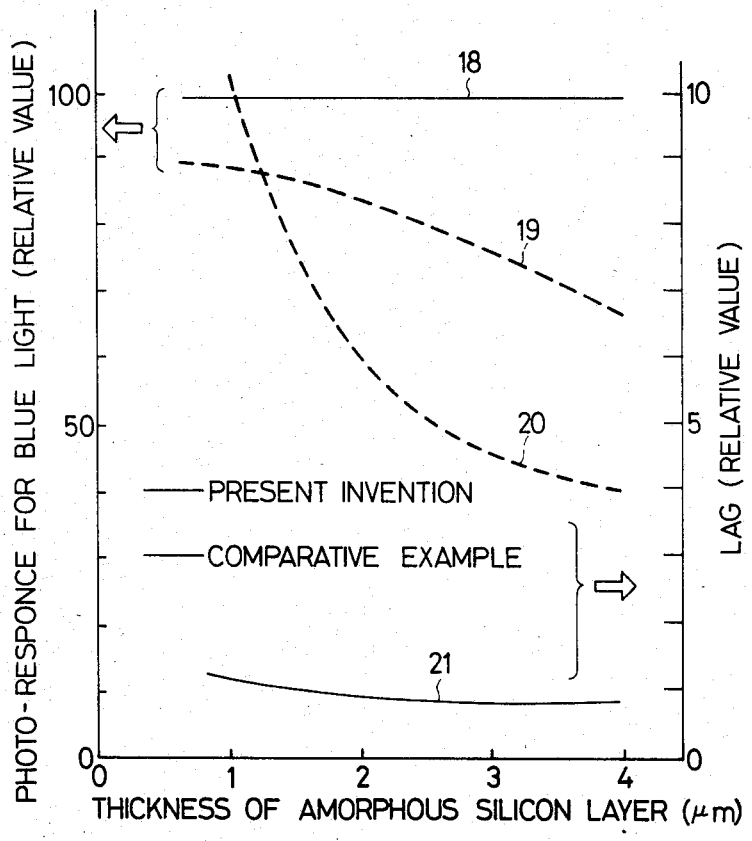
FIG. 8 is a diagram for explaining the effects of improving lag and photo-response for blue light.

FIG. 8 compares the variations of photo-response for blue light versus the thickness of an a-Si:H layer, between the present invention 18 and a case 19 where a-Si:H was applied to the conventional LP mode. In addition, curves 20 and 21 indicate lag in the conventional LP mode and lag in the present invention, respectively. In the conventional LP mode employing the a-Si:H, the layer thickness thereof needs to be rendered at least 2 μm in order to attain the visually satisfactory lag 20. Unfavorably, however, the photo-response for blue light at this time is considerably lower than in case of a thin layer, and when the thickness is further increased with the intention of improving the lag 20, the photoresponse for blue light decreases more.

In contrast, as qualitatively explained before, the image pickup tube of the present invention is of low lag and is free from the thickness-dependency 21 of the lag. It is also understood that, since the transition of electrons used as the predominant carriers is excellent, the thickness-dependency 18 of the photo-response for blue light is scarcely involved.

The characteristics in FIGS. 7 and 8 are those of the image pickup tube having the setup of Example 2. Equal effects can be obtained with the other examples.

In image pickup tubes of the LP mode currently put in practical use, holes are generally utilized as the predominant carriers. When a-Si:H is applied to such tube, the holes of inferior transition must be used as the predominant carriers. Therefore, especially increase in the photoconductive lag and degradation in the photoresponse for blue light pose problems. Further, it renders the problems more serious to increase the thickness of the layer of the a-Si:H with the intention of reducing the capacitive lag attendant upon the LP mode. In contrast, in image pickup tubes of the HN mode employing the photoconductor layer in which the a-Si:H layer is formed with the secondary electron emission layer as described in the examples, the electrons of excellent transition can be used as the predominant carriers, and hence, the problems of the conventional method can be sharply improved as stated above.

Moreover, the a-Si:H is extraordinarily durable mechanically and thermally. It has been known that it incurs quite no change in characteristics in spite of electron bombardment by high velocity electron beam scanning over a long time. Thus, it can be expected to attain excellent image pickup tube characteristics having hitherto been unattainable.

What is claimed is:

1. An image pickup tube comprising:

means including an electron source for producing a primary electron beam;

a target to be scanned on one side by said primary electron beam, said target being capable of emitting secondary electrons in response to bombardment by primary electrons with a secondary electron emission ratio which is greater than one, and including a transparent conductive layer, and a photoconductor layer which is essentially made of amorphous silicon containing hydrogen and is formed on said transparent conductive layer;

a balancing electrode disposed between said target and said electron source for collecting secondary electrons emitted from said one side of said target; and means for biasing the light incidence side of said photoconductor layer negatively with respect to the electron beam incidence side of said photoconductor layer, so that the tube operates in a high velocity beam scanning negatively charge biased mode.

2. An image pickup tube as defined in claim 1, wherein said photoconductor layer contains at least one element selected from the group consisting of group-IIIb and group-Vb elements, and the contents of the elements are distributed in a thickness direction of said layer so that a group-IIIb element may assume a maximum content value at a boundary surface of said photoconductor layer with said transparent conductive layer, while a group-Vb element may assume a maximum content value on a beam scanning side thereof.

3. An image pickup tube as defined in claim 2, wherein the maximum value of the content of the group-IIIb or group-Vb element is 200 ppm in atomic-% for each group.

4. An image pickup tube as defined in claim 1 or 2, further comprising a light-transmissive p-type semiconductor layer between said transparent conductive layer and said photoconductor.

5. An image pickup tube as defined in claim 4, wherein said light-transmissive p-type semiconductor layer is formed of a material in which hydrogen-containing amorphous silicon is doped with a group-IIIb element.

6. An image pickup tube as defined in claim 4, wherein said light-transmissive p-type semiconductor layer is formed of a material which is an amorphous solid solution consisting of silicon and carbon and containing hydrogen.

7. An image pickup tube as defined in claim 1 or 2, further comprising a light-transmissive metal film between said transparent conductive layer and said photoconductor layer, said film constituting a rectifying heterojunction with the hydrogen-containing amorphous silicon.

8. An image pickup tube as defined in claim 1 or 2, wherein an n-type semiconductor layer formed of amorphous silicon nitride, or a material in which hydrogen-containing amorphous silicon is doped with a group-Vb element, is provided on the beam scanning side of said photoconductor layer.

9. An image pickup tube as defined in claim 8, wherein said layer for secondary electron emission is a layer which has a secondary emission ratio greater than 1 (one) for bombardment with accelerated primary electrons of 0.1 kV to 2 kV.

10. An image pickup tube as defined in claim 1, wherein said biasing means operates to bias said balancing electrode positively with respect to said transparent conductive layer.

11. An image pickup tube including means including a cathode for producing a primary electron beam;

a target to be scanned on one side by said primary electron beam, including a light transmissive insulating substrate, a transparent conductive layer formed on said light transmissive insulating substrate, a photoconductor layer which is essentially made of amorphous silicon containing hydrogen and which is formed on said transparent conductive layer, and a layer disposed on said photoconductor layer facing said balancing mesh electrode for emitting secondary electrons with a secondary electron emission ratio greater than one in response to bombardment by primary electrons of said primary electron beam;

a balancing mesh electrode for collecting secondary electrons emitted from said one side of said target; and means for biasing the light incidence side of said photoconductor layer negatively with respect to the electron beam incidence side of said photoconductor layer.

12. An image pickup tube as defined in claim 11, wherein said layer for secondary electron emission is a layer which has a secondary emission ratio of at least 1 (one) for bombardment with accelerated electrons of 0.1 kV to 2 kV.

13. An image pickup tube as defined in claim 11, wherein said photoconductor layer contains at least one element of group-IIIb or group-Vb, and contents of the elements are distributed in a thickness direction of said layer so that the group-IIIb element may assume a maximum content value at a boundary surface of said photoconductor layer with said transparent conductive layer, while the group-Vb element may assume a maximum content value on a beam scanning side thereof.

14. An image pickup tube as defined in claim 13, wherein the maximum value of the content of the group-IIIb or group-Vb element is 200 ppm in atomic-% for each group.

15. An image pickup tube as defined in claim 11, further comprising a light-transmissive p-type semiconductor layer disposed between said transparent conductive layer and said photoconductor.

16. An image pickup tube as defined in claim 15, wherein said light-transmissive p-type semiconductor layer is formed of a material in which hydrogen-containing amorphous silicon is doped with a group-IIIb element.

17. An image pickup tube as defined in claim 15, wherein said light-transmissive p-type semiconductor layer is formed of a material which is an amorphous solid solution consisting of silicon and carbon and containing hydrogen.

18. An image pickup tube as defined in claim 11, further comprising a light-transmissive metal film between said transparent conductive layer and said photoconductor layer, said film constituting a rectifying heterojunction with the hydrogen-containing amorphous silicon.

19. An image pickup tube as defined in claim 11, wherein an n-type semiconductor layer is disposed between said photoconductor layer and said layer for emitting secondary electrons and is formed of amorphous silicon nitride or a material in which hydrogen-containing amorphous silicon is doped with a group-Vb element.

* * * * *